US012351955B2

(12) United States Patent
Binder et al.

(10) Patent No.: US 12,351,955 B2
(45) Date of Patent: Jul. 8, 2025

(54) STIMULUS-RESPONSIVE MESH

(71) Applicant: Technische Universitat Dresden, Dresden (DE)

(72) Inventors: Simon Binder, Magdeburg (DE); Adrian Ehrenhofer, Dresden (DE); Alice Mieting, Dresden (DE)

(73) Assignee: TECHNISCHE UNIVERSITAT DRESDEN (DE)

( * ) Notice: Subject to any disclaimer, the term of this patent is extended or adjusted under 35 U.S.C. 154(b) by 859 days.

(21) Appl. No.: 17/329,371

(22) Filed: May 25, 2021

(65) Prior Publication Data

US 2022/0380950 A1 Dec. 1, 2022

(51) Int. Cl.
*D04B 21/12* (2006.01)
*D02G 3/36* (2006.01)
(Continued)

(52) U.S. Cl.
CPC ..... *D04B 21/12* (2013.01); *D02G 3/36* (2013.01); *D04B 1/16* (2013.01); *D04B 21/16* (2013.01);
(Continued)

(58) Field of Classification Search
CPC ... D04B 1/16; D10B 2401/02; D10B 2401/04
See application file for complete search history.

(56) References Cited

U.S. PATENT DOCUMENTS

2003/0156991 A1 8/2003 Halas et al.
2008/0057809 A1* 3/2008 Rock ..... D06M 15/643 442/119
(Continued)

FOREIGN PATENT DOCUMENTS

AU 2009213041 A1 * 10/2009 ..... A61K 49/0457

OTHER PUBLICATIONS

Lu Peng et al., Macroscopic vol. Change of Dynamic Hydrogels Induced by Reversible DNA Hybridization, Journal of the American Chemical Society, Jun. 28, 2012, vol. 134, pp. 12302-12307 (13 pages including 6 pages of Supporting Information).
(Continued)

*Primary Examiner* — Jenna L Johnson
(74) *Attorney, Agent, or Firm* — Barnes & Thornburg LLP; Jeffrey R. Stone

(57) ABSTRACT

This disclosure relates to a stimulus-responsive mesh made from hydrogel fibers that provide varying degrees of ventilation depending on environmental conditions. The hydrogel fibers may be arranged into a mesh with openings that change size depending on the degree of swelling of the hydrogel fibers. As the hydrogel fibers of the mesh change (e.g., from a contracted state to/from a swollen state), fluids may flow through the mesh at a variable flow rate that depends on the degree of swelling. The swelling of the hydrogel fibers may be responsive to changes in the ambient environment experienced by the mesh, including, for example, the moisture level at the mesh, the temperature level of the mesh, the chemical composition of the moisture incident the mesh, the presence of magnetic/electric fields near the mesh, and/or the light level at the mesh. In this manner, the ambient environment may determine the degree of swelling of the hydrogel fibers, and changes in the environment may cause moisture to be actively expelled from the mesh. The stimulus-responsive mesh may be used in a variety of products and may be particular useful, for example, for outdoor products such as bicycle helmets, tent screens, and outdoor clothing.

20 Claims, 7 Drawing Sheets

(51) Int. Cl.
*D04B 1/16* (2006.01)
*D04B 21/16* (2006.01)

(52) U.S. Cl.
CPC ..... *D10B 2401/02* (2013.01); *D10B 2401/04* (2013.01)

(56) References Cited

U.S. PATENT DOCUMENTS

| | | | | |
|---|---|---|---|---|
| 2013/0344761 | A1* | 12/2013 | Williams | D01F 8/00 264/103 |
| 2020/0124317 | A1 | 4/2020 | Sribhashyam et al. | |
| 2020/0131695 | A1* | 4/2020 | Lao | D06M 23/16 |

OTHER PUBLICATIONS

Daniela Franke et al., Performance of Fast-Responsive, Porous Crosslinked Poly(N-Isopropylacrylamide) in a Piezoresistive Microsensor, IEEE Sensors Letters, Nov. 15, 2017, vol. 1, No. 6, at 1500904 (Dec. 2017, IEEE Sensors Council) (4 pages).

Simon Binder et al., Semi-Interpenetrating Polymer Networks Based on Nisopropylacrylamide and 2-acrylamido-2-methylpropane Sulfonic Acid for Intramolecular Force-Compensated Sensors, Journal of the Electrochemical Society, vol. 167 at 167521, Jan. 6, 2021 (The Electro Chemical Society) (8 pages).

Adrian Ehrenhofer et al., An automatically rainproofing bike helmet through light-sensitive hydrogel meshes: design, modeling and experiments, Proceedings of SPIE 11375, Electroactive Polymer Actuators and Devices (EAPAD) XXII, 113750N, May 26, 2020 (13 pages).

* cited by examiner

STIMULUS-RESPONSIVE MESH

TECHNICAL FIELD

The disclosure herein relates generally to materials, methods of manufacture, and uses of stimulus-responsive meshes, and in particular, stimulus-responsive meshes formed from hydrogels.

BACKGROUND

The present application relates generally to meshes and hydrogels. Mesh is a web or net that is made up of numerous strands of fiber. Due to the stranded structure, mesh is a porous material that allows particles that are smaller than the pores to pass through the mesh while at the same time blocking particles that are larger than the pores. A hydrogel is a material, typically a crosslinked polymer, that is hydrophilic. Due to its hydrophilic nature, a hydrogel may expand in size without losing its structural integrity when exposed to high concentrations of water. As a result, hydrogels are typically highly absorbent and have a variety of uses from disposable diapers to biomedical implants.

BRIEF DESCRIPTION OF THE DRAWINGS

Throughout the drawings, like reference numbers are used to depict the same or similar elements, features, and structures. The drawings are not necessarily to scale, emphasis instead generally being placed upon illustrating aspects of the disclosure. In the following description, some aspects of the disclosure are described with reference to the following drawings, in which.

DESCRIPTION

Figure 1A:
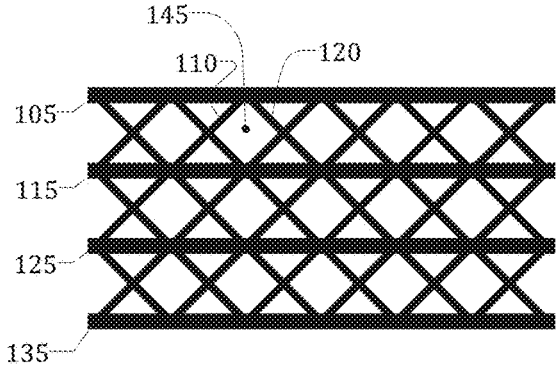
FIGS. 1A-1C show exemplary meshes that have openings between fibers of the mesh.

The following detailed description refers to the accompanying drawings that show, by way of illustration, specific details and aspects in which the disclosure may be practiced. One or more aspects are described in sufficient detail to enable those skilled in the art to practice the disclosure. Other aspects may be utilized and structural, logical, mechanical, and chemical changes may be made without departing from the scope of the disclosure. The various aspects described herein are not necessarily mutually exclusive, as some aspects can be combined with one or more other aspects to form new aspects. Various aspects are described in connection with methods and various aspects are described in connection with devices and vice versa. However, it may be understood that aspects described in connection with methods may similarly apply to the devices, and vice versa. Throughout the drawings, it should be noted that like reference numbers are used to depict the same or similar elements, features, and structures.

As discussed in more detail below, the present disclosure provides for a stimulus-responsive mesh that may vary the size of its pores based on various environmental stimuli, including, without limitation, moisture level, temperature level, chemical composition, magnetic/electric fields, and light level experienced at the mesh. For example, the stimulus-responsive mesh may automatically close its pores in a rainstorm such that the mesh becomes airtight and/or watertight. When the rain has stopped, the pores in the mesh automatically reopen to quickly restore the breathability of the mesh. The disclosed stimulus-responsive mesh is particularly advantageous where it is desirable for the mesh to have variable ventilation, depending on the changes to the environment. If the environment is dry, for example, the stimulus-responsive mesh may have wide open pores (e.g., for high ventilation and breathability). If the environment becomes wet, for example, the stimulus-responsive may narrow or close its pores (e.g., for water resistance or water proofing), and then the stimulus-responsive mesh may reopen its pores after the environment returns to a dry environment. As a result of its environmental responsiveness, the stimulus-responsive mesh automatically provides excellent performance to match the current environmental conditions.

The disclosed stimulus-responsive mesh is not limited to moisture responsiveness (e.g., moisture/humidity levels of the ambient environment) and may also respond to other environmental factors including but not limited to temperature of the ambient environment, light levels incident on the mesh, magnetic/electric fields near the mesh, and/or chemical composition of the ambient environment. The stimulus-responsive mesh may be particularly useful in outdoor products, including but not limited to bicycle helmets, tent window screens, and clothing.

The disclosed stimulus-responsive mesh is particularly advantageous over known mesh materials that provide both ventilation and water resistance. Known mesh materials that provide both ventilation and water resistance typically fall into two categories: (1) meshes having a removable waterproof cover and (2) meshes made from waterproof textiles such as poly-vinyl-chloride (PVC) or GoreTex®. Each type has undesirable tradeoffs with respect to convenience and breathability of the fabric. A mesh fabric that utilizes a removeable waterproof cover, for example, may provide excellent breathability and ventilation due to its wide-pored mesh structure. Alone, however, the mesh is not waterproof, and it requires adding an extra layer of waterproof fabric that must be added or removed as environmental conditions change from rainy to dry, and vice-versa. The disadvantage is that multiple layers of material are required and it is inconvenient to manually add or remove the extra layer of material as conditions change.

A mesh made from a waterproof textile like PVC or GoreTex® has the advantage of being both waterproof and potentially breathable, but this type of mesh provides only a limited amount of breathability/ventilation that may not be suitable for applications where high levels of ventilation may be desirable, such as when the mesh is used in a window screen for an outdoor tent or for lining a bike helmet. The disadvantage is that the level of breathability is fixed and relatively low, such that these types of materials are not suitable to use in environments where a high degree of ventilation may be desired.

The disclosed stimulus-responsive mesh overcomes these disadvantages because it may be highly breathable with widely-open pores that provide excellent ventilation in certain environments (e.g., when its not raining or when the garment wearer is sweating). If the environment changes (e.g., when it begins to rain, when the garment wearer stops sweating, or when the temperature or light level changes, etc.), the disclosed stimulus-responsive mesh may automatically change by narrowing or completely closing the openings/pores in the mesh. The narrower openings in the mesh provides lower ventilation and, if the openings/pores are essentially completely closed, may provide waterproofing, in response to the new environmental conditions. Further advantages of the disclosed stimulus-responsive mesh will be apparent from the examples discussed in more detail below.

In an example, the disclosed stimulus-responsive mesh may be responsive to changes in moisture level (e.g., water incident the mesh) of the ambient environment experienced at the mesh. If the moisture level increases, the stimulus-responsive mesh may respond by narrowing its pores to partially or fully restrict the flow of fluids through the mesh. Thus, in a highly humid or wet environment (e.g., when water is incident the mesh), for example, the stimulus-responsive mesh may narrow its pores to such an extent that the pores are completely sealed, and fluid is not permitted to flow through the mesh. Alternatively, the stimulus-responsive mesh may narrow its pores to such an extent that air is partially permitted to flow through the mesh while water is blocked. If the moisture level decreases, the stimulus-responsive mesh may reopen/widen its pores to allow fluids to again flow through the mesh. In this sense, the openings in the mesh permit fluid to flow through the mesh at a variable flow rate, controlled by the size of the openings that depend on environmental conditions. A dry environment, for example, may provide a baseline flow rate (e.g., a maximum flow rate) for the flow of fluid (e.g., air) through the mesh (e.g., fully open pores with non-swollen hydrogel fibers), while a wet environment, for example, may provide a reduced flow rate through the pores (e.g., partially or fully closed pores) as compared to the baseline flow rate.

As used herein, the term "flow rate" refers to the rate at which a volume of fluid (e.g., air) may flow through a given portion of the mesh. Wide openings in the mesh may allow a large volume of fluid to flow through the mesh (e.g., a high flow rate), which provides higher ventilation and breathability. Narrower openings in the mesh may allow a lower volume of fluid to flow through the mesh (e.g., a lower flow rate), which decreases ventilation and breathability. And if the openings are narrow enough, the openings may not allow a fluid to flow through the mesh at all (e.g., a flow rate of zero), which provides no ventilation or breathability.

In an example, the disclosed stimulus-responsive mesh may be additionally or alternatively responsive to changes in temperature (e.g., a temperature level) of the ambient environment experienced at the mesh. If the temperature decreases, the stimulus-responsive mesh may respond by narrowing its pores to partially or fully restrict the flow of fluids through the mesh. Thus, in a cold environment (e.g., when the mesh is exposed to cooler temperatures), for example, the stimulus-responsive mesh may narrow its pores to such an extent that the pores are completely sealed, and fluid is not permitted to flow through the mesh. Alternatively, the stimulus-responsive mesh may narrow its pores to such an extent that air is partially permitted to flow through the mesh while water is blocked. If the temperature increases (e.g., when the mesh is exposed to warmer temperatures), the stimulus-responsive mesh may reopen/widen its pores to again allow fluids to flow through the mesh. In this sense, the openings in the mesh permit fluid to flow through the mesh at a variable flow rate, controlled by the size of the openings that depend on environmental conditions. A hot environment, for example, may provide a baseline flow rate (e.g., a maximum flow rate) for the flow of fluids (e.g., air) through the mesh (e.g., fully open pores with non-swollen hydrogel fibers), while a cold environment, for example, may provide a reduced flow rate through the pores (e.g., partially or fully closed pores) as compared to the baseline flow rate.

In an example, the disclosed stimulus-responsive mesh may be additionally or alternatively responsive to changes in light (e.g., light levels) of the ambient environment experienced at the mesh. If the light decreases, the stimulus-responsive mesh may respond by narrowing its pores to partially or fully restrict the flow of fluids through the mesh. Thus, in a dark environment (e.g., when the mesh is exposed to low levels of light), for example, the stimulus-responsive mesh may narrow its pores to such an extent that the pores are completely sealed, and fluid is not permitted to flow through the mesh. Alternatively, the stimulus-responsive mesh may also partially narrow its pores to such an extent that air is partially permitted to flow through the mesh while water is blocked. If the light increases (e.g., when the mesh is exposed to higher levels of light), the stimulus-responsive mesh may reopen/widen its pores to again allow fluids to flow through the mesh. In this sense, the openings in the mesh permit fluid to flow through the mesh at a variable flow rate, controlled by the size of the openings that depend on environmental conditions. A bright environment, for example, may provide a baseline flow rate (e.g., a maximum flow rate) for the flow of fluids (e.g., air) through the mesh (e.g., fully open pores with non-swollen hydrogel fibers), while a dark environment, for example, may provide a reduced flow rate through the pores (e.g., partially or fully closed pores) as compared to the baseline flow rate.

In an example, the disclosed stimulus-responsive mesh may be additionally or alternatively responsive to changes in chemical composition (e.g., the salinity level (e.g., the concentration of sodium ions)) of the ambient environment experienced at the mesh. If the salinity level decreases, the stimulus-responsive mesh may respond by narrowing its pores to partially or fully restrict the flow of fluids through the mesh. Thus, in an environment with a low salinity level (e.g., when the mesh is exposed to fluids with a low concentrations of sodium ions, such as in a rain storm), for example, the stimulus-responsive mesh may narrow its pores to such an extent that the pores are completely sealed, and fluid is not permitted to flow through the mesh. Alternatively, the stimulus-responsive mesh may narrow its pores to such an extent that air is partially permitted to flow through the mesh while water is blocked. If the concentration of sodium ions increases (e.g., when the mesh is exposed to sweat), the stimulus-responsive mesh may reopen/widen its pores to again allow fluids to flow through the mesh. In this sense, the openings in the mesh permit fluid to flow through the mesh at a variable flow rate, controlled by the size of the openings that depend on environmental conditions. An environment that has a high salinity level, for example, may provide a baseline flow rate (e.g., a maximum flow rate) for the flow of fluids (e.g., air) through the mesh (e.g., fully open pores with non-swollen hydrogel fibers), while an environment with a low salinity level, for example, may a provide a reduced flow rate through the pores (e.g., partially or fully closed pores) as compared to the baseline flow rate.

To achieve a mesh that is responsive to changes in environmental conditions, the stimulus-responsive mesh may be formed from an array of hydrogel fibers that are arranged to form pores (e.g., the openings between hydrogel fibers) within the mesh. The hydrogel fibers of the mesh may be arranged in a crossed pattern, a grid pattern, a random pattern, or any other arrangement that creates openings between hydrogel fibers in the mesh. The hydrogel fibers may be textile strands (e.g., strands of wool, cotton, nylon, latex, etc.) that are coated in hydrogel(s) or that are impregnated with hydrogel(s). Alternatively, the fibers may themselves be strands of hydrogel(s). As used herein, the term "fiber" is meant to refer to the individual strands that form the mesh pattern (e.g., the intersecting strands that form the openings/pores in the mesh). Each "fiber" or "strand" may itself may be composed of multiple filaments. For example, a yarn is a "fiber" or"strand" composed of multiple filaments of cotton, wool, or other materials that have been drawn together into a "strand" or "fiber." It is this resulting fiber or strand that may then be patterned into a stimulus-responsive mesh.

As used herein, the term "impregnate," "impregnating," and "impregnated" refers to soaking a core fiber in a hydrogel such that at least some of the voids between the multiple filaments that may make up the core fiber may be filled (at least partially) with a hydrogel. In this manner, the hydrogel may enter the interior of the core fiber and some or all of the voids between individual filaments that make up the core fiber may be filled with the hydrogel. An exemplary way of impregnating a fiber with a hydrogel is to dip the fibers of the mesh into a highly viscose prepolymer solution. This allows the prepolymer solution to infiltrate the voids between the filaments of the fiber so that the polymerization process may start before the filaments de-wet. Then, the hydrogel polymerizes around the filaments, where the hydrogel may not necessarily adhere chemically (e.g., not connected via covalent or ionic bonds) but rather physically (e.g., via Van der Waals forces, hydrogen bonds). Without a highly viscos prepolymer solution, merely soaking the fibers of the mesh may not impregnate the fiber with the hydrogel because repulsion may lead to de-wetting of the filaments before polymerization starts. Other examples to fabricate impregnated fibers may use a surface treatment of the filaments to support the infiltration of the voids, e.g. the formation of functional groups or a plasma treatment to make the filament hydrophilic.

For the coating process various binding techniques may be used. For example, a self-assembling monolayer of functional groups, e.g. bases on thiols, may be formed on the core's surface so that covalent bonds may be developed during the polymerization process. In another example, the core may be made of a material that may act as an electrode, so that a locally specific crosslinking polymerization may be initiated via electric fields to form a coating thickness of a desired dimension. In general, coating may be formed via a localized polymerization around the core but it may also be possible to attach an already fabricated hydrogel to the core surface, so that polymerization and coating are timely separated processes. An adhesive may be used to attach the previously fabricated hydrogel to the core. The hydrogel may come in the form of a powder or granulate to ensure a good surface coverage of the core.

Meshes made from hydrogel fibers that are themselves formed completely from hydrogel(s) may be fabricated in a mold that already has the shape of the desired mesh, so that the polymerization of the pre-gel solution results in the desired mesh. In another example, a layer of pre-gel solution may be locally crosslinked via a ultraviolet (UV) initiator using locally selective UV exposure only in the area where the mesh is to be formed. Stereolithographic techniques, as they are used in 3D printing, for example, or masking techniques may also be used. In another example, an imprint process using a polydimethylsiloxane (PDMS) stamp, which contains the desired mesh structure, may be used in combination with a UV exposure to achieve the desired mesh. While with the previous techniques the mesh structure will be achieved during the crosslinking process, it may also be possible to perform the crosslinking step without any mesh structuring in order to first form a thin hydrogel layer. Then, in a second step, the mesh may be formed using punches to create the openings in the mesh, for example, or using other methods to locally remove hydrogel material (e.g., via Laser). Lastly, single fibers may be drawn from a pre-gel solution or fabricated in another appropriate way and those fibers may then be knitted into a mesh with the desired pore/opening size between fibers of the mesh.

Figure 1B:
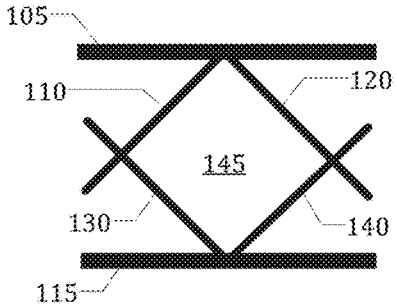
Figure 1C:
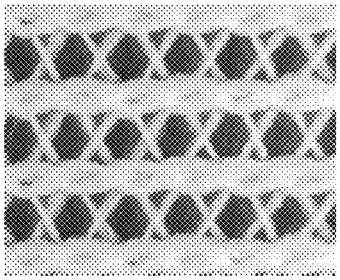

FIGS. 1A-1C show exemplary arrays of fibers that have been arranged to form a mesh. The exemplary mesh of FIG. 1A shows horizontally-arranged fibers 105, 115, 125, and 135 along with crisscrossed fibers 110, 120 that form a meshed pattern with opening 145. (To avoid crowding the figure, not all fibers/strands or openings have been labeled; it should be understood that a plurality of intersecting fibers/strands form a plurality of openings throughout the mesh. In addition, it should be understood that FIG. 1A is only a representative section of a larger portion of the mesh material that may be any size or dimension). FIG. 1B is a zoomed-in view of FIG. 1A that more clearly shows how multiple fibers may interact to form pores/openings in the mesh. In particular, opening 145 is formed from the intersection of angled fibers 130, 110, 120, and 140 along with horizontally arranged fibers 105 and 115. As should be understood, any arrangement of any number of fibers may be used to form openings, such as opening 145, in the mesh. FIG. 1C is a photo of a portion of an actual mesh material made from strands of yarn that is designed to have a mesh pattern that is substantially the same as that depicted in FIG. 1A.

It should be appreciated that the hydrogel fibers that form the mesh, as well its openings, may be of varying dimensions. For example, the horizontally-arranged fibers 105, 115, 125, and 135 may be about 1.3 mm in diameter, but this diameter may be much larger or much smaller according to the structural requirements of the mesh. Similarly, the distance between horizontally-arranged fibers 105, 115, 125, and 135 may be about 3.2 mm, but this distance may be much larger or much smaller according to the structural requirements of the mesh. Similarly, the diameter of opening 145 may be about 2.2 mm, but this diameter may be much larger or much smaller according to the structural requirements of the mesh.

Figure 2:
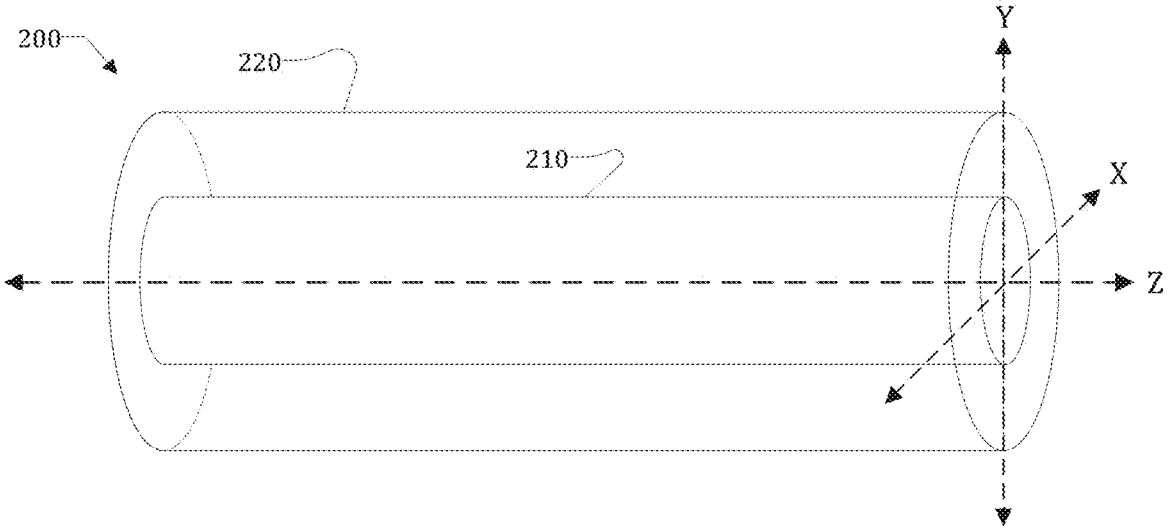
FIG. 2 shows an exemplary hydrogel fiber that has been formed from, coated with, and/or impregnated with a hydrogel that may be used in a stimulus-responsive mesh.

FIG. 2 shows an exemplary hydrogel fiber 200 that may be used to form a stimulus-responsive mesh. Core fiber 210 (e.g., a passive strand of, e.g., yarn, or itself a hydrogel strand) may be fully or partially coated with hydrogel 220. By coating core fiber 210 with hydrogel 220, the resulting hydrogel fiber 200 becomes responsive to external stimuli according to the properties of the hydrogel coating. In addition, the hydrogel 220 may impregnate the core fiber 210 so that hydrogel 220 not only surrounds core fiber 210 but also fills some or all of the voids of the interior of core fiber 210, including, for example some or all of the voids between filaments that make up core fiber 210. By impregnating the core fiber 210 with hydrogel 220, the resulting hydrogel fiber 200 may be responsive to external stimuli in a different manner than a core fiber that is merely coated with hydrogel. For example, impregnating the core fiber 210 may provide conduits for water (or other external stimuli) to enter or exit the hydrogel more quickly, thereby accelerating the swelling or deswelling of the hydrogel fiber 200 in response to the external stimuli. In addition, the hydrogel fiber 200 may be formed entirely from a hydrogel (or a combination of hydrogels) such that, for example, the core fiber 210 may itself be a hydrogel that is coextensive in diameter with hydrogel fiber 200, or core fiber 210 may be a hydrogel (or made from hydrogel filaments) that has been coated with a second hydrogel 220 to form hydrogel fiber 200.

Figure 3:
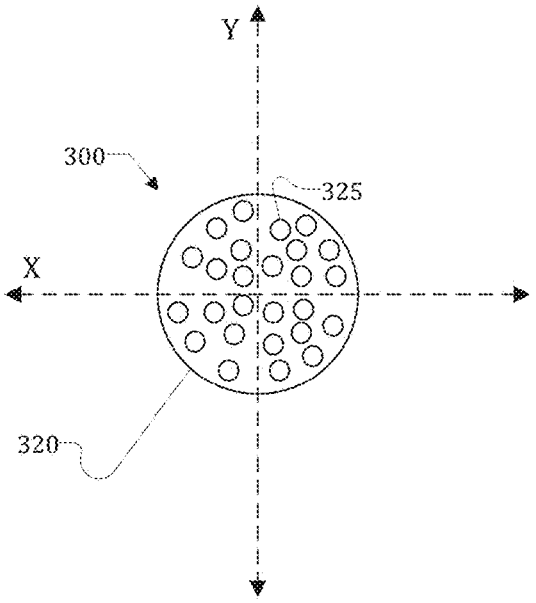
FIG. 3 shows a cross-section of an exemplary fiber formed from numerous filaments, where the fiber may be formed from, coated with, and/or impregnated with a hydrogel for use in a stimulus-responsive mesh.
Figure 4:
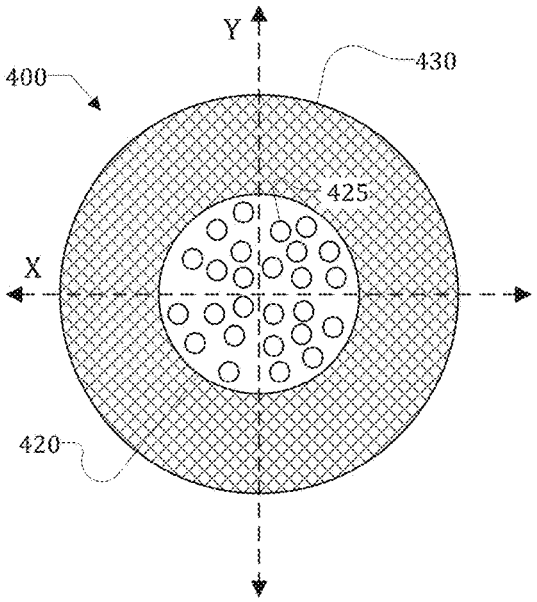
FIG. 4 shows a cross-section of an exemplary hydrogel fiber formed from a passive fiber coated in a hydrogel that may be used in a stimulus-responsive mesh.
Figure 5:
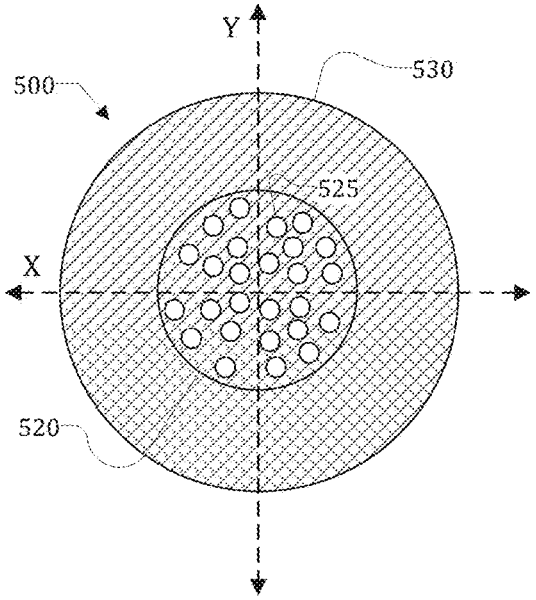
FIG. 5 shows a cross-section of an exemplary hydrogel fiber formed from a passive fiber coated in and impregnated with a hydrogel that may be used in a stimulus-responsive mesh.

FIGS. 3-6 show cross sections of fibers, cut perpendicular to its Z-axis. In the example of FIG. 3, cross section 300 reveals a core fiber 320 that may be comprised of numerous interior filaments 325 and voids between adjacent interior filaments 325. Together, these interior filaments 325 (and corresponding voids in between) form the interior of core fiber 320. In FIG. 4, cross section 400 reveals a core fiber 420 with interior filaments 325. Core fiber 420 has been coated with hydrogel 430 (illustrated by the hatched pattern). As cross section 400 shows, the interior of core fiber 420 has not been impregnated with hydrogel 430 because the voids between interior filaments 325 have not been filled with hydrogel. By contrast, FIG. 5 shows cross section 500 where the core fiber 520 has been coated with hydrogel 530 (illustrated by the hatched pattern) and the interior of the core fiber 520 has been impregnated with hydrogel 530 because the voids between some of the interior filaments 525 have been filled with hydrogel 530 (illustrated by the hatched pattern inside core fiber 520). As a result, impregnated core fiber 520 may no longer be a purely passive fiber because the network configuration of the impregnated hydrogel 530 may extend through the interior of the core fiber so that it works actively in combination with the surrounding hydrogel coating to respond to environmental stimuli.

Figure 6:
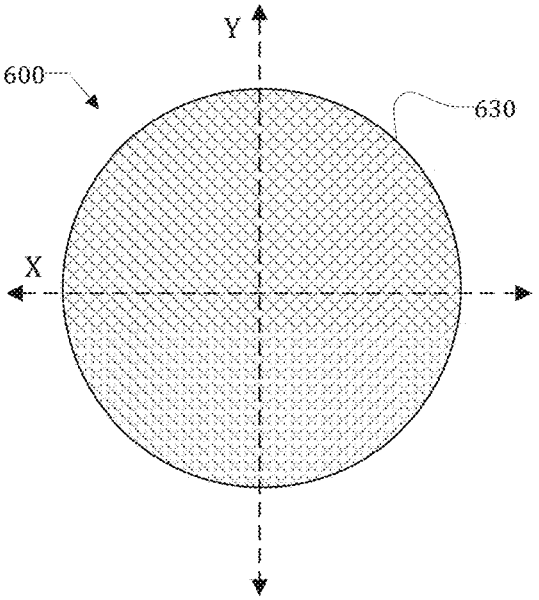
FIG. 6 shows a cross-section of an exemplary hydrogel fiber formed from a hydrogel that may be used in a stimulus-responsive mesh.

In FIG. 6 the exemplary hydrogel fiber 200 is not formed with a passive core. Instead, as shown by cross section 600, hydrogel 630 is itself formed from a hydrogel and is coextensive with hydrogel fiber 200. As should be appreciated, the cross sections in FIGS. 3-6 are merely exemplary, and the hydrogel fiber 200 may be formed with any combination of the above-described techniques.

Depending on the desired responsiveness of the mesh to environmental stimuli, the hydrogel(s) used to coat, impregnate, or form the hydrogel fiber may be selected to be responsive to any number of environmental changes (e.g., moisture, temperature, incident light, magnetic/electric fields, and/or chemical compositions) in the ambient environment experienced by the hydrogel fiber. Thus, if the environment changes in one manner, the hydrogel fiber may expand in volume from a contracted state to a swollen state, thereby changing the size of the pores of the mesh (e.g., narrowing and/or completely closing the pores of the mesh). If the environment changes in another manner, the hydrogel fiber may decrease in volume from a swollen state to a contracted, thereby changing the size of the pores of the mesh (e.g., opening and/or widening the pores of the mesh). Depending on the degree of swelling of the hydrogel fiber, which is itself dependent on the environment experienced at the mesh, the pores have a variable size such that fluids may flow through mesh at a variable flow rate depending on the environmental stimuli. In addition, the environmental responsiveness of the hydrogel fiber to one stimulus may actively influence its responsiveness to another stimulus. For example, a hydrogel fiber that is in a swollen state due to exposure to a wet environment may, when exposed to another responsive stimulus (e.g., brighter light), may actively cause the hydrogel fiber to expel or take up water. In other words, the hydrogel fiber may not rely solely on evaporation to reverse the degree of swelling caused by its exposure to water, but rather, other environmental stimuli may actively change/counteract the degree of swelling. This type of active response to multiple stimuli allows the hydrogel fiber to quickly respond to changing environments.

Figure 7A:
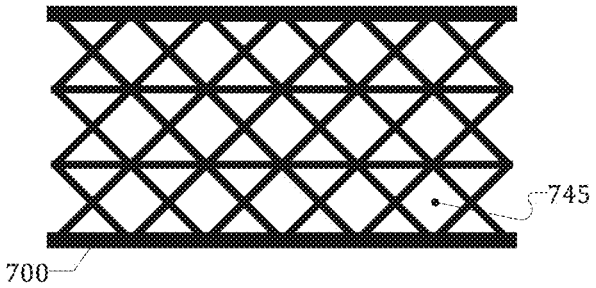
FIGS. 7A-7B show exemplary views of a stimulus-responsive mesh in a contracted state and having intersecting hydrogel fibers that form openings within the mesh.
Figure 7B:
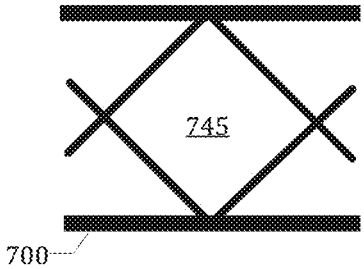

FIGS. 7A-7B, 8A-8B, 9A-9B show an exemplary progression of various swelling states of a stimulus-responsive mesh formed from hydrogel fibers that have been coated, impregnated, and/or made from hydrogel(s). FIG. 7A shows an array of intersecting hydrogel fibers 700 in a contracted state of swelling such that an array of openings (represented by opening 745) is formed between intersecting hydrogel fibers. FIG. 7B is a zoomed-in view of a portion of FIG. 7A to more clearly show how the array of hydrogel fibers interact to form an array of openings in the mesh. In this contracted state of swelling, fluid may flow at a baseline rate. The baseline rate may represent the highest level of ventilation/fluid flow exhibited by the mesh.

Figure 8A:
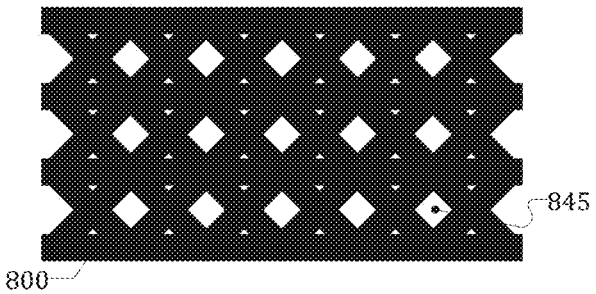
FIGS. 8A-8B show exemplary views of a stimulus-responsive mesh in a partially swollen state, the mesh having intersecting hydrogel fibers that form narrower openings within the mesh.
Figure 8B:
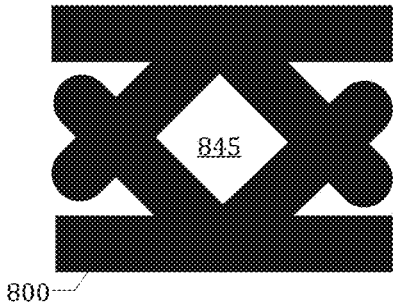

Moving to FIGS. 8A and 8B, the hydrogel fibers of the stimulus-responsive mesh are in a swollen state as compared to FIGS. 7A and 7B. Intersecting hydrogel fibers 800 are slightly swollen such that the openings (represented by opening 845) between intersecting hydrogel fibers are much narrower. In this expanded state of swelling, the narrower openings may cause fluid to flow through the mesh at a reduced flow rate that is below the baseline rate. In addition, the narrower openings may permit only certain fluids with smaller particle sizes (e.g., air) to pass through the mesh, while preventing other fluids with larger particle sizes (e.g., water) to pass through the mesh.

Figure 9A:
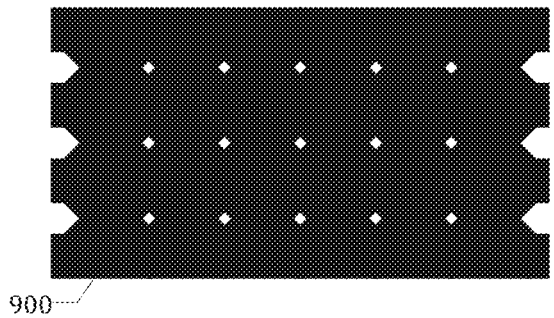
FIGS. 9A-9B show exemplary views of a stimulus-responsive mesh in a fully (or nearly fully) swollen state, the mesh having intersecting hydrogel fibers that fully (or nearly fully) close the openings within the mesh.
Figure 9B:
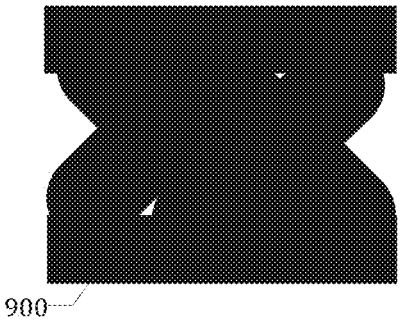

Moving to FIGS. 9A and 9B, the hydrogel fibers of the stimulus-responsive mesh are in a more swollen state as compared to FIGS. 7 and 8. Intersecting hydrogel fibers 900 are swollen to a much greater degree such that there are virtually no openings in the mesh. In this highly expanded state of swelling, fluids (e.g., water) may not flow through the mesh at all, and if any do, they would flow at a highly reduced flow rate compared to the baseline rate.

Any number of hydrogels may be selected for use in the hydrogel fibers of the stimulus-responsive mesh. By way of example, a hydrogel especially suitable for impregnating a fiber, due to its high viscos pre-gel solution, is [net-PAA]-sipn-PAMPS. As an example of a light sensitive hydrogel, net-PNiPAAm-co-chlorophyllin copolymer may be used. Light sensitivity may also be reached via antibody-antigen bindings or cDNA hybridization of hydrogels, so that the photoresponsive molecular recognition leads to a change in the swelling degree. An example for the second one is a hydrogel based on Acrylamide and Polyacrylamide strands with grafted azobenzene-tethered, single-stranded DNA and its complentary DNA.

Other examples are [net-P(AMPS-co-NiPAAm)]-sipn-PAMPS (see FIG. 12) or [net-P(AMPS-co-NiPAAm)]-ipn-[net-P(AMPS-co-NiPAAm)], both of which exhibit temperature sensitivity and sodium ion concentration sensitivity. As a further example, a hydrogel may be selected that has light-responsive particles dispersed within the hydrogel that influence the hydrogel's functional groups in a way that changes the degree of swelling of the hydrogel. These particles may be in size range of nanometers to micrometers. These particles may also be, for example, dark particles (e.g., magnetite nanoparticles) that may increase heat transfer to the hydrogel via absorption. In this way, a kind of light sensitivity may be achieved because the temperature sensitive hydrogel heats up faster compared to a hydrogel without particles, and, thus, changes its swelling state much faster. Other particles may be used that convert illumination into heat within the hydrogel. For example, particles such as metal nanoshells may be used, which convert light (in a wavelength-specific manner) into heat based on plasmon resonance. Of course, any particles that transfer light into heat may be used to form hydrogel fibers that are light-sensitive.

For the hydrogel fibers to be sensitive to magnetic or electric fields, particles may be incorporated into the hydrogel that convert the energy from magnetic fields or electric fields into heat. For example, magnetite particles may be used, which will heat up due to hysteresis losses when exposed to alternating magnetic fields. If used in combination with temperature sensitive hydrogels described above, the hydrogel fiber may change its volume according to, for example, the frequency and/or strength of the external alternating magnetic field. Such a composition using such particles may be advantageous for creating hydrogel fibers that are responsive to changes in light conditions, changes in temperature, and/or changes in magnetic fields.

In addition, as hydrogels may be soft or brittle, it may be desirable to introduce longer polymer strands of, for example, sulfonic acid, when synthesizing the hydrogel fibers to provide improved mechanical functionality. Other techniques maybe used to improve the mechanical behavior of the resulting hydrogel fibers. For example, varying the cross-linking density, incorporating stabilizing particles to which the polymer may bind, or using interpenetrating polymer network (IPN or ipn) structures. In particular, longer polymer strands of sulfonic acid may allow for the hydrogel itself to be drawn into a hydrogel fiber (or into hydrogel filaments of a hydrogel fiber), as discussed above. In addition, in order to vary the speed at which the hydrogel fiber swells and de-swells, pores may be introduced into the hydrogel when synthesizing the hydrogel. Micro-porous and macro-porous hydrogels may be created during the fabrication by, for example, cryogelation, tenside templates (e.g. via surfactant Brij L23), adjusting the temperature during cross-linking, using macroscopic molds/templates, 3D-printing the hydrogel while leaving channels, etc. Micro-porous and macro-porous hydrogels may additionally or alternatively, be created after the hydrogel formation by material ablation (e.g., using a focused laser or particle beam). Using the temperature and salt sensitive hydrogel [net-P(AMPS-co-NiPAAm)]-sipn-PAMPS as an example, it may have improved mechanical properties due to the semi-interpenetrating polymer network structure (semi-IPN or sipn). It may also respond to changes in light levels of the ambient environment if it contains, for example, black magnetite nano particles. And it may swell and shrink much faster when it also includes pores (e.g., in the range of 100 nm) (formed, e.g., using the surfactant Brij L23). Combinations of the above-described hydrogels and/or combinations of the techniques for introducing stimulus-responsiveness properties to the hydrogel may be used, and the above-listed examples are not intended to be limiting.

To synthesize a suitable hydrogel, any number of accepted methods may be used. One non-limiting example of a hydrogel that may have a proper viscos pre-gel solution for impregnating a textile filament core is [net-PAA]-sipn-PAMPS. In another non-limiting example, the hydrogel [net-PAA]-sipn-PAMPS may be synthesized by dissolving acrylamide (AA, approximately 22.61 mg, Sigma Aldrich) and N,N'-methylene-bis-acrylamide (BIS, approximately 0.21 mg, Sigma Aldrich) in double deionized water (approximately 82 μL) and adding approximately 15 wt % poly(2-acrylamido-2-methyl-1-propanesulfonic acid) (PAMPS, average molecular weight: 2,000,000 g mol-, mass fraction of the solution: 15 wt % in water, approx. 200 μL Sigma Aldrich). Next, free radical polymerization may be started by adding ammonium peroxodisulfate (APS, approximately 0.20 mg, Sigma Aldrich) and N,N,N',N'-tetramethylethylenediamine (TMEDA, approximately 1 μL, Carl Roth). Next, the pre-gel may be applied to the mesh with a pipette and polymerized overnight at a constant temperature, approximately 40° C.

In another example of synthesize a suitable hydrogel, the temperature and salt sensitive semi-IPN hydrogel [net-P(AMPS-co-NiPAAm)]-sipn-PAMPS may be synthesized by purifying N-isopropylacrylamide (NiPAAm, Acros Organics) by recrystallization from n-hexane. 2-acrylamido-2-methylpropane sulfonic acid (AMPS, Sigma Aldrich), long polymer strands of this sulfonic acid (PAMPS, average molecular weight: 2,000,000 g $mol^{-1}$, mass fraction of the solution: 15 wt % in water, Sigma Aldrich), N,N'-methylenebisacrylamide (BIS, Merck) and N,N,N',N'-tetramethylethylenediamine (TMEDA, Sigma Aldrich) may be used without further purification. The initiator sodium peroxodisulphate (NaPS, Riedel-de Haën) may be used as an approximately 0.84 molar aqueous solution (approximately 1.00 g in 5.0 ml of water).

For the polymerization, a redox-initiated free radical polymerization in water in an argon atmosphere may be used. NiPAAm (approximately 1057.3 mg, 9.343 mmol), AMPS (approximately 59.9 mg, 0.289 mmol), BIS (approximately 59.4 mg, 0.385 mmol), PAMPS (approximately 363.3 mg of the solution) and NaPS (approximately 57.3 μl of the stock solution, 0.048 mmol) may be dissolved in approximately 7.9 ml deionized water. Sodium hydroxide solution NaOH (approximately 600 μl of a stock solution with concentration approximately 1 mol $l^{-1}$) may be added to have predominantly basic conditions. The solution may be degassed and cooled in iced water for approximately 10 min. The polymerization may be initiated by adding TMEDA (approximately 7.3 μl, 0.048 mmol) and the resulting hydrogel may be cooled at approximately 15° C. for approximately 3 hours. To make the hydrogel light-sensitive magnetite particles of the size of approximately 200 nm in diameter may be added before initiation of the polymerization in a way that the weight proportion will be approximately 20% of the dry polymer weight. The particles may be incorporated using a constant rotation/movement in order to achieve a homogenous distribution of the particles, though other methods may be used. To make the hydrogel porous, a tenside (e.g., Brij L23) may be added before initiation of the polymerization to form micelles. After the crosslinking, the tenside may be washed out from the hydrogel to form the pores with diameters in nm range. As should be appreciated, other tensides may be used (e.g., Span 80, Tween 80, etc.).

Figure 10:
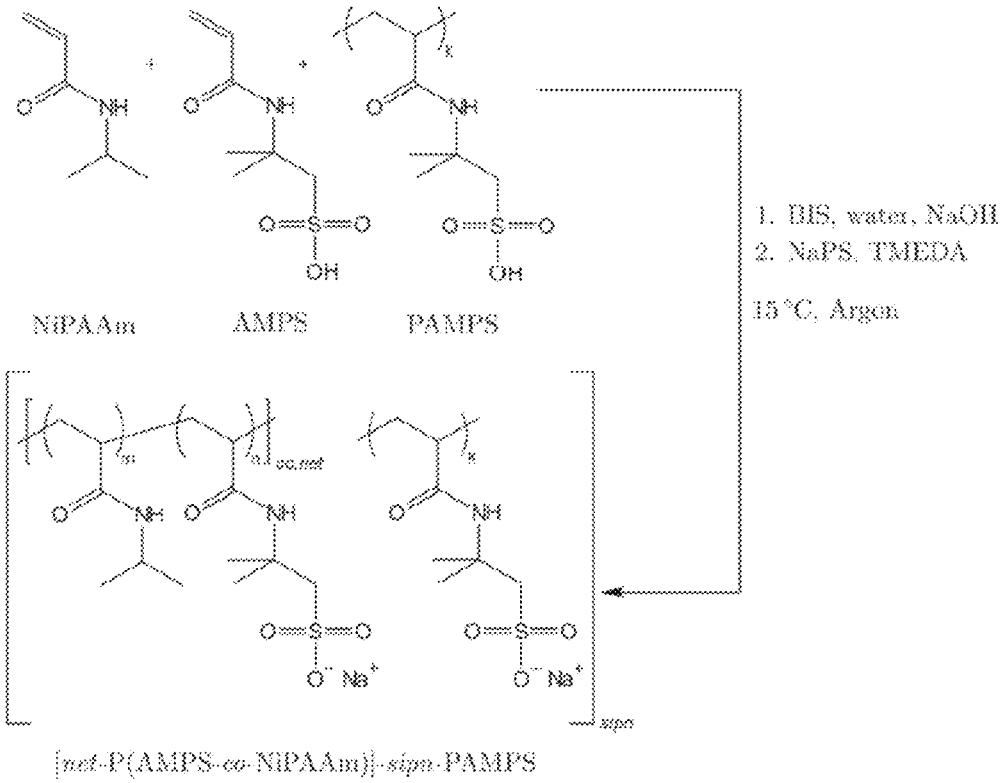
FIG. 10 shows an exemplary reaction scheme for the synthesis of an exemplary hydrogel with a semi-interpenetrating polymer network (semi-IPN or sipn) configuration that may be used in a stimulus-responsive mesh.

An exemplary reaction scheme for the synthesis of the exemplary semi-IPN hydrogel, [net-P(AMPS-co-NiPAAm)]-sipn-PAMPS, discussed above is shown in FIG. 10.

Figure 11:
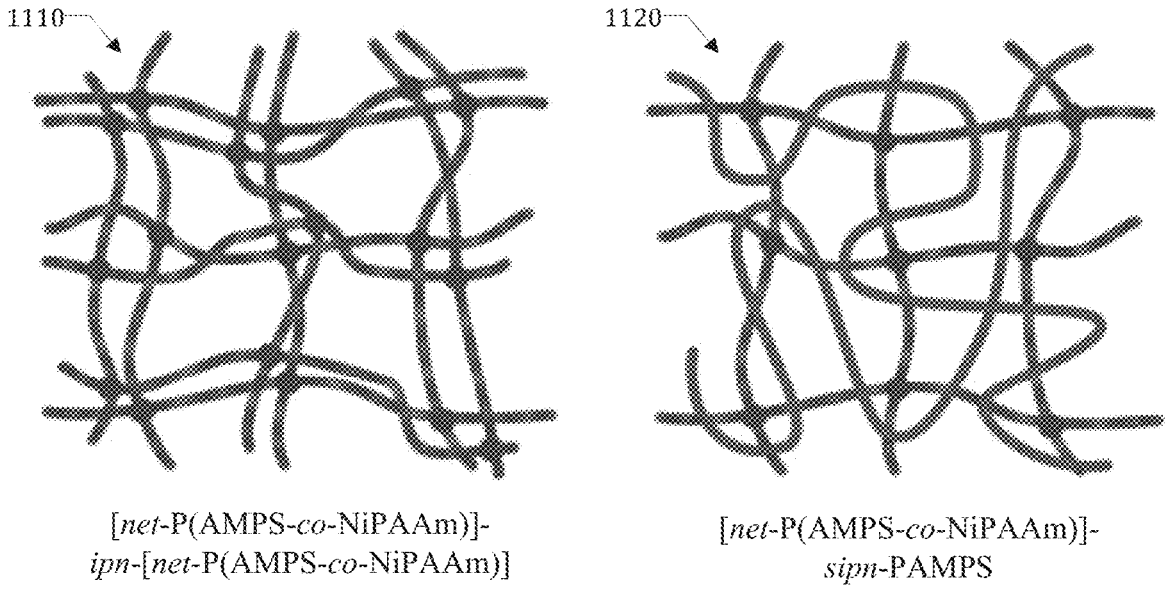
FIG. 11 shows exemplary hydrogels with differing polymer network configurations that may be used for a stimulus-responsive mesh, one hydrogel has a polymer network configuration based on interpenetrating polymer networks (IPN or ipn) and another hydrogel has a polymer network configuration based on semi-interpenetrating polymer networks (semi-IPN or sipn)

FIG. 11 illustrates the architecture or network configuration of two exemplary hydrogels. The first is an IPN hydrogel 1110 ([net-P(AMPS-co-NiPAAm)]-ipn-[net-P(AMPS-co-NiPAAm)]), which consists of interpenetrating polymer networks based on [net-P(AMPS-co-NiPAAm)] formed in two separate cross-linking steps. IPN hydrogel 1110 may have a comprehensive strength ($F_B$) strength of approximately 23.3±4.5 N for a specific sample size and exhibit an approximately linear responsiveness to changes in temperature and sodium concentration (scaled logarithmically). The second exemplary hydrogel of FIG. 11 is semi-IPN hydrogel 1120 ([net-P(AMPS-co-NiPAAm)]-sipn-PAMPS), which consists of a cross-linked copolymer permeated by linear PAMPS polymer strands formed using a single crosslinking step. Semi-IPN hydrogel 1120 may have a comprehensive strength ($F_B$) strength of more than 40 N for the same specific sample size and exhibit an approximately linear responsiveness to changes in temperature and sodium concentration (scaled logarithmically).

The selection of the particular hydrogel may depend on the desired responsiveness of the mesh to external stimuli. For example, it may be desirable to use a hydrogel that is not only sensitive to changes in moisture but is also sensitive to the presence of a solution of sodium chloride (NaCl), and in particular, sensitive to an ion concentration of sodium ($c_{Na+}$) in the incident moisture. In this way, the pores of the mesh may respond to changes in sodium ion concentration in the moisture incident the mesh. In addition, the hydrogel may have an alternative or additional sensitivity to temperature so that the degree of swelling may also depend on temperature of the mesh. Being sensitive to temperature may allow the hydrogel to have temperature-compensated swelling such that for a given moisture level or for a given concentration of sodium ions in the moisture, the degree of swelling may be lower for a higher temperature and higher for a lower temperature, or vice versa. Indeed, any stimulus to which the hydrogel responds may serve to counterbalance (or augment) the degree of swelling caused by any other stimulus or combination of stimuli. The degree of swelling of the hydrogel should be understood as being dependent on any number of dimensions of a multi-dimensional array of environmental stimuli.

In addition, the speed at which the hydrogel may respond to a given stimulus may vary depending on the stimulus. For example, the degree of swelling of the hydrogel may respond more quickly to changes in temperature level than to changes in sodium ion concentration. This type of effect may be desirable, for example, in applications where it is important to respond more quickly to unexpected changes in moisture level (e.g., to quickly waterproof a helmet when a rainstorm begins) as compared to the gradual changes in sodium ion concentration that may occur slowly over time (e.g., to slowly open the pores as sweating gradually becomes more profuse). As another example, it may be desirable for the degree of swelling of the hydrogel to respond more quickly to temperature changes than to changes in the sodium ion concentration in order for the mesh to stabilize to a particular degree of swelling for the given temperature before adjusting the swelling to compensate for changes in sodium ion concentrations.

Figure 12:
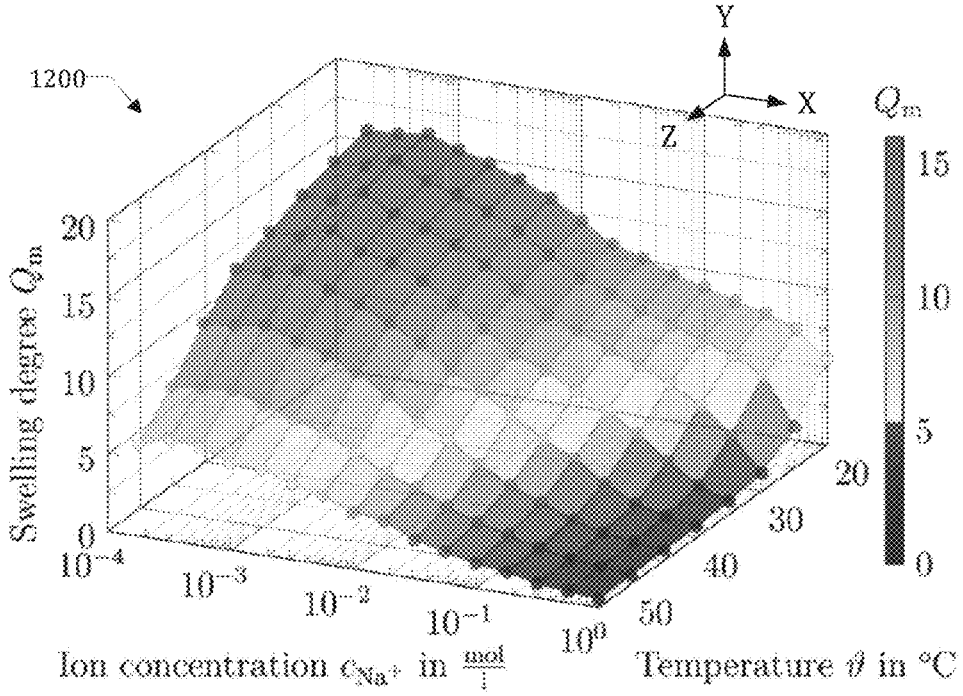
FIG. 12 shows a plot of an exemplary swelling behavior of an exemplary stimulus-responsive hydrogel that may be used in a stimulus-responsive mesh.

Turning to FIG. 12, for example, graph 1200 plots the multi-dimensional effects of temperature and ion concentration on the degree of swelling of semi-IPN hydrogel 1120. Temperature experienced by the hydrogel (° C.) is plotted along the Z-axis, sodium ion concentration experienced by the hydrogel (mol/l) is plotted along the X-axis, and the degree of swelling of the hydrogel (Qm) is plotted along the Y-axis. As shown in this exemplary 3-D surface plot, for a given concentration of sodium ions ($c_{Na+}$), a lower temperature results in a higher degree of swelling and a higher temperature results in a lower degree of swelling. And, for a given temperature, a higher concentration of sodium ions results in lower swelling than for a lower concentration of sodium ions. Sweat, for example, has a sodium ion concentration of approximately 1-4 g/l (i.e., 0.02-0.07 mol/l. At this concentration, for example, the hydrogel volume may be decreased by 50% as compared to water with little to no concentration of sodium ions (e.g., rainwater).

Figure 13:
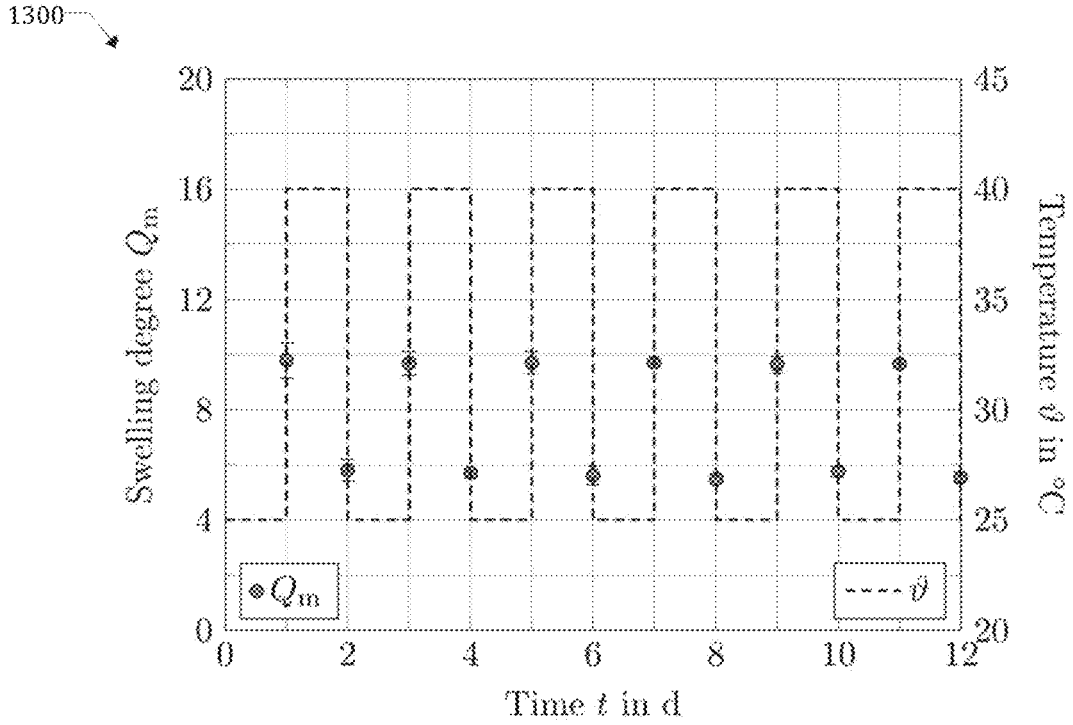
FIG. 13 shows a plot of an exemplary reversible swelling behavior at alternating temperatures and a constant sodium ion concentration of an exemplary stimulus-responsive hydrogel that may be used in a stimulus-responsive mesh.

Similarly, FIG. 13 depicts graph 1300 which plots the degree of swelling of semi-IPN hydrogel 1120 at two alternating temperatures over time to show reversibility of the volume phase transition. The degree of swelling of the hydrogel (Qm) is plotted along the first Y-axis, the temperature experienced by the hydrogel (° C.) is plotted along the second Y-axis, time is plotted along the X-axis, and the sodium ion concentration is held constant.

These types of graphs, e.g., FIGS. 11 and 12, are not intended to be limiting, and it should be understood that such plots may be extended in any number of dimensions to show how changes in any type of environmental stimuli, including those discussed above, may impact the degree of swelling of the hydrogel over changes in, for example, moisture, temperature, light levels, magnet/electric fields, and/or chemical composition of the ambient environment.

Figure 14:
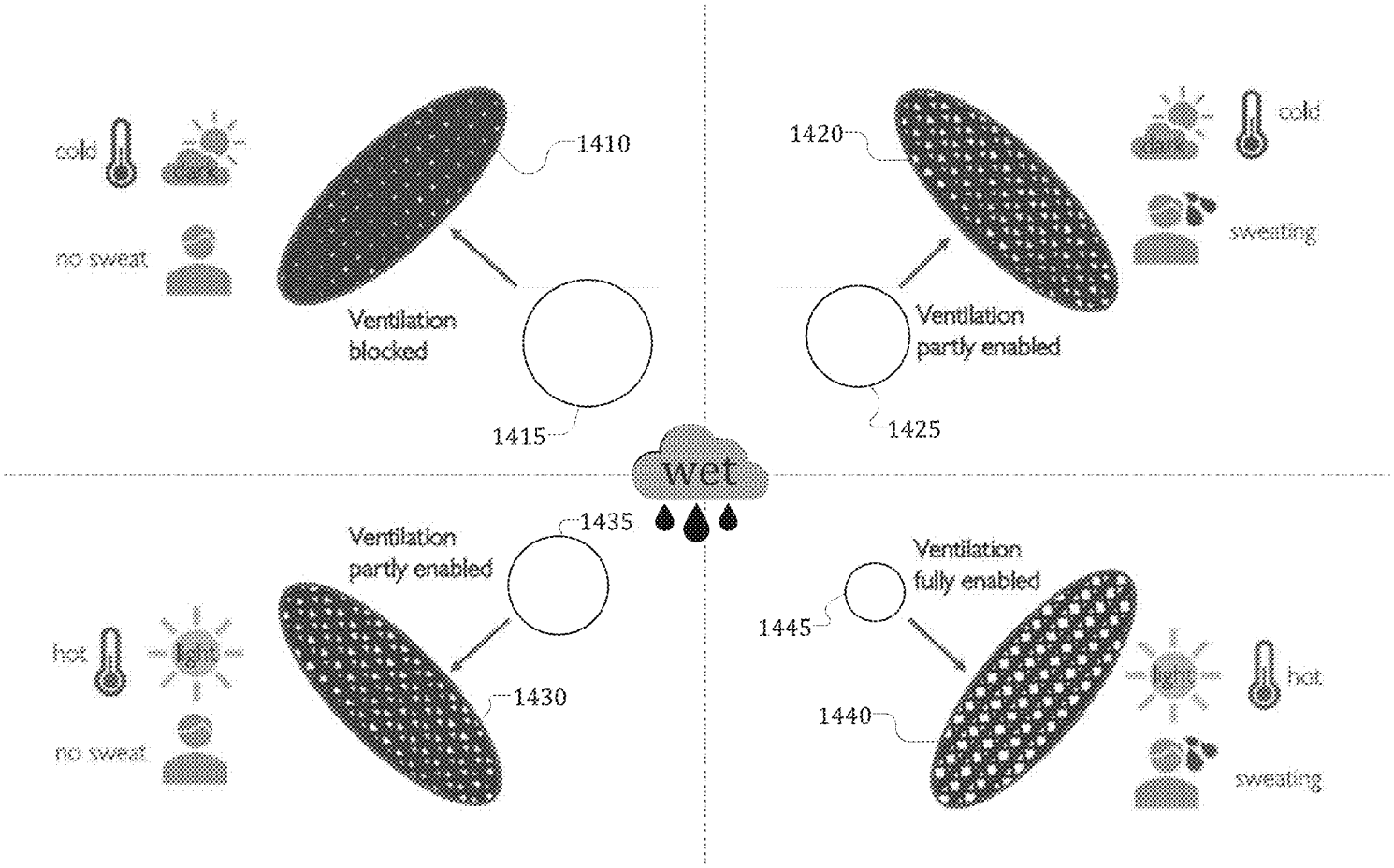
FIG. 14 is an exemplary depiction of how various environmental stimuli may impact the swelling of the hydrogel fibers of a stimulus responsive mesh.

FIG. 14 is a stylized depiction of how various environmental stimuli may impact the variable swelling of the fibers of a stimulus responsive mesh in a wet environment. In the upper left quadrant, this depicts a wet environment that is cold, dark, and with little to no proportion of sweat (e.g., low sodium ion concentration). In this case, the mesh 1410 may have fibers 1415 in a highly swollen state (e.g., a Qm of 17.5) such that mesh 1410 has very small pores that may block fluid flow/ventilation through mesh 1410. In the upper right quadrant, this depicts an environment that is cold, dark, and with a high proportion of sweat (e.g., high sodium ion concentration). In this case, the mesh 1420 may have fibers 1425 in a partially swollen state (e.g., a Qm of 9.1) such that mesh 1420 has medium-sized pores that may partially block fluid flow/ventilation through mesh 1420. In the lower left quadrant, this depicts an environment that is hot, light, and with little to no proportion of sweat. In this case, the mesh 1430 may have fibers 1435 in a partially swollen state (e.g., a Qm of 9.4) such that mesh 1430 has medium-sized pores that may partially block fluid flow/ventilation through mesh 1430. In the lower right quadrant, this depicts an environment that is hot, light, and with a high proportion of sweat. In this case, the mesh 1440 may have fibers 1445 in a nonswollen state (e.g., a Qm of 1.6) such that the mesh 1440 has very large pores that may provide full ventilation, allowing fluid to fully flow through mesh 1440.

Figure 15:
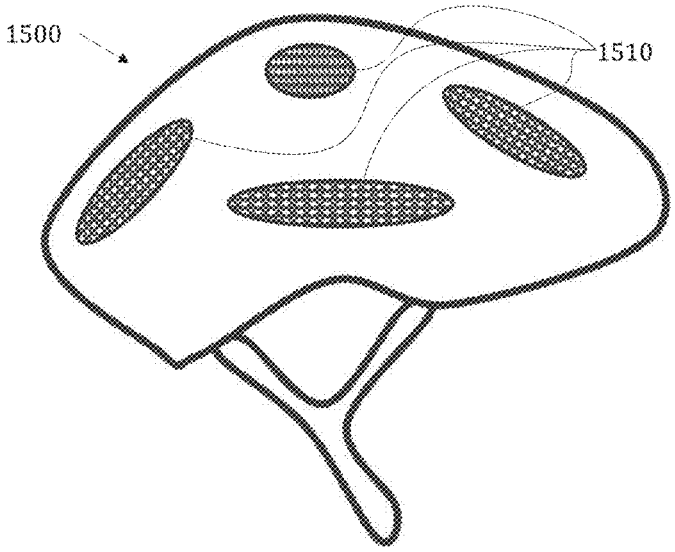
FIG. 15 is an exemplary depiction of a bike helmet fitted with a stimulus responsive mesh.
Figure 16:
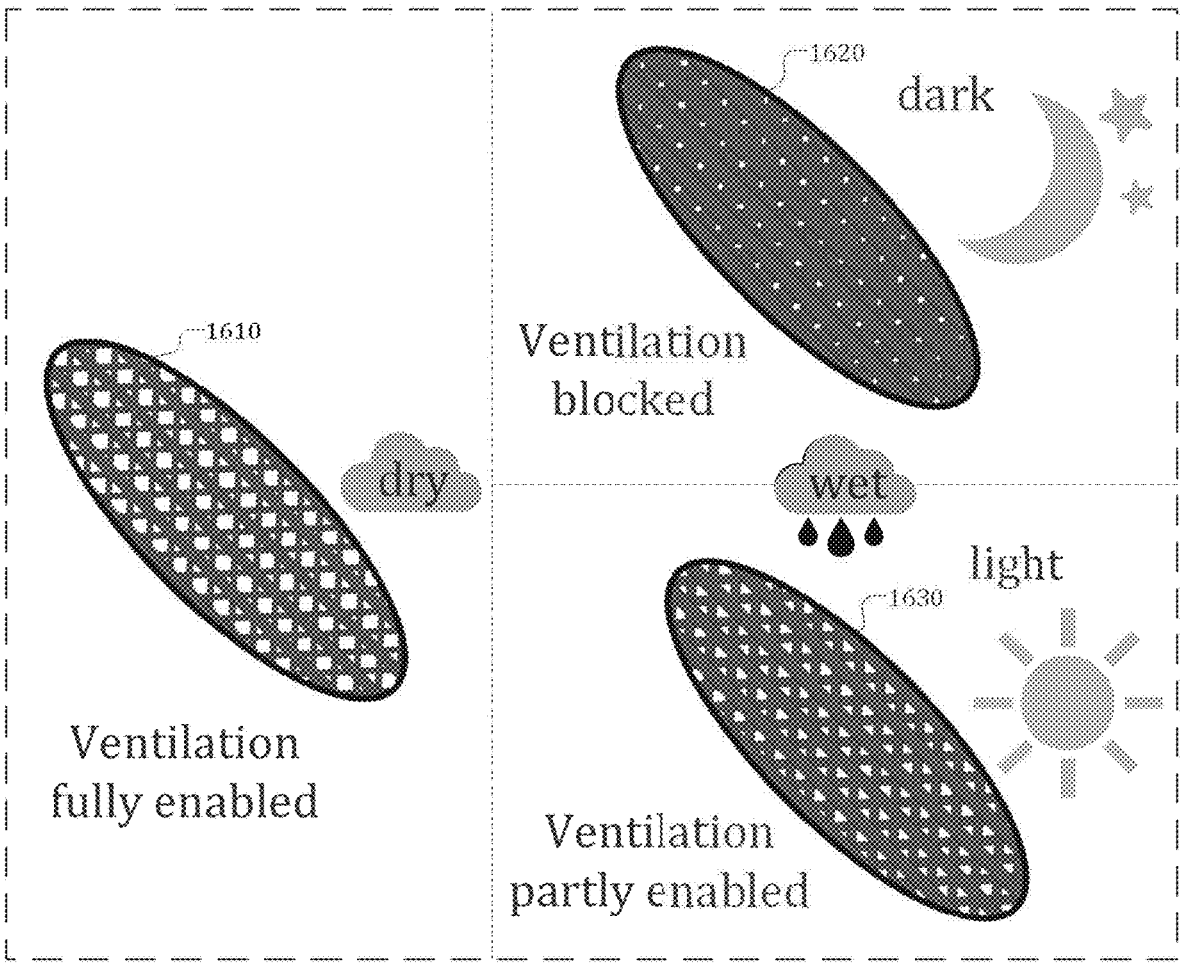
FIG. 16 is an exemplary depiction how various environmental stimuli may impact the swelling of the hydrogel fibers of a stimulus responsive mesh that may be fitted in a bike helmet.

FIG. 15 depicts an exemplary bike helmet 1500 that has been fitted with a stimulus responsive mesh. Bike helmet 1500 has ventilation areas 1510 that have been lined with a stimulus responsive mesh. The stimulus responsive mesh may respond to environmental stimuli in any manner discussed above. As one example, FIG. 16 shows how the ventilation areas 1510 of FIG. 15 may respond to various environmental stimuli such as changes in moisture level and changes in light. Changes in these environmental stimuli may impact the variable swelling of the fibers of the stimulus responsive mesh fitted into the ventilation areas of the bike helmet. In the upper left portion of FIG. 16, for example, the environment is wet and dark, such that the mesh may be in a highly swollen state (e.g., fully swollen state 1620) with very small pores that may block fluid flow/ventilation. In the lower left portion of FIG. 16, the environment is wet and bright, such that the mesh may be in a partially swollen state (e.g., partially swollen state 1630) such that the mesh has medium-sized pores that may partially block fluid flow/ventilation. In the left portion of FIG. 16, the environment is dry, such that the mesh may be in a nonswollen state (e.g., contracted state 1610) with very large pores that may provide full ventilation, allowing fluids to fully flow through the mesh.

The word "exemplary" is used herein to mean "serving as an example, instance, or illustration." Any example or design described herein as "exemplary" is not necessarily to be construed as preferred or advantageous over other examples or designs.

The words "plurality" and "multiple" in the description or the claims expressly refer to a quantity greater than one. The terms "group (of)", "set [of]", "collection (of)", "series (of)", "sequence (of)", "grouping (of)", etc., and the like in the description or in the claims refer to a quantity equal to or greater than one, i.e. one or more. Any term expressed in plural form that does not expressly state "plurality" or "multiple" likewise refers to a quantity equal to or greater than one.

It is appreciated that implementations of methods detailed herein are exemplary in nature, and are thus understood as capable of being implemented in a corresponding device. Likewise, it is appreciated that implementations of devices detailed herein are understood as capable of being implemented as a corresponding method. It is thus understood that a device corresponding to a method detailed herein may include one or more components configured to perform each aspect of the related method.

All acronyms defined in the above description additionally hold in all claims included herein.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A stimulus-responsive mesh, the mesh comprising:

hydrogel fibers arranged to form openings within the mesh, wherein the size of the openings depends on a degree of swelling of the hydrogel fibers, and wherein the hydrogel fibers are configured to change the degree of swelling responsive to changes in an ambient environment of the mesh, wherein the degree of swelling depends on a moisture level of the ambient environment such that when the environment becomes wet, the size of openings decreases, and wherein the degree of swelling further depends on a salinity level of the ambient environment.

2. The mesh of claim 1, wherein changes in the ambient environment comprise changes in the moisture level, the salinity level, and a temperature level and/or a light level of the ambient environment.

3. The mesh of claim 1, wherein when the moisture level increases, the degree of swelling increases, and as the moisture level decreases, the degree of swelling decreases.

4. The mesh of claim 1, wherein the hydrogel fibers are further configured to actively expel moisture from the hydrogel fibers in response to an increased light level, an increased salinity level, and/or an increased temperature level of the ambient environment.

5. The mesh of claim 1, wherein the degree of swelling corresponds to a volume of the hydrogel fibers.

6. The mesh of claim 1, wherein the hydrogel fibers comprise a textile core coated in a hydrogel.

7. The mesh of claim 6, wherein the textile core comprises filaments arranged to form voids between the filaments, wherein the voids are at least partially filled with a hydrogel.

8. The mesh of claim 1, wherein the hydrogel fibers comprise a strand of hydrogel.

9. The mesh of claim 1, wherein the hydrogel fibers comprise a porous hydrogel.

10. The mesh of claim 1, wherein the hydrogel fibers comprise a hydrogel formed from semi-interpenetrated polymer networks comprising a acrylamide polymer network semi-interpenetrated with strands of poly(2-acrylamido-2-methyl-1-propanesulfonic acid).

11. The mesh of claim 1, wherein the hydrogel fibers comprise a hydrogel formed from semi-interpenetrated polymer networks comprising a copolymer based on N-isopropylacrylamide and 2-acrylamido-2-methylpropane sulfonic acid semi-interpenetrated with strands of poly(2-acrylamido-2-methyl-1-propanesulfonic acid).

12. The mesh of claim 1, wherein the hydrogel fibers comprise a hydrogel formed from interpenetrating polymer networks based on N-isopropylacrylamide and 2-acrylamido-2-methylpropane sulfonic acid.

13. The mesh of claim 1, wherein the hydrogel fibers comprise a hydrogel with nanoparticles dispersed within the hydrogel.

14. The mesh of claim 1, wherein the openings permit a fluid to flow through the mesh at a variable flow rate that depends on the degree of swelling.

15. The mesh of claim 1, wherein at a first degree of swelling, a fluid is permitted to flow through the mesh at a first flow rate, and at a second degree of swelling that is larger than the first degree of swelling, the fluid is permitted to flow through the mesh at a second flow rate that is lower than the first flow rate.

16. The mesh of claim 1, wherein at a maximum degree of swelling, water is not permitted to flow through the mesh.

17. The mesh of claim 1, wherein the degree of swelling further depends on the salinity level such that as the salinity level decreases the degree of swelling increases and as the salinity level increases, the degree of swelling decreases.

18. The mesh of claim 1, wherein changes in the ambient environment comprise changes in a temperature level of the ambient environment, and wherein the degree of swelling further depends on the temperature level such that as the temperature level decreases the degree of swelling increases, and as the temperature level increases, the degree of swelling decreases.

19. The mesh of claim 1, wherein changes in the ambient environment comprise changes in a light level of the ambient environment, and wherein the degree of swelling further depends on the light level such that as the light level decreases the degree of swelling increases, and as the light level increases, the degree of swelling decreases.

20. A stimulus-responsive mesh, the mesh comprising:

hydrogel fibers arranged to form openings within the mesh, wherein the size of the openings depends on a degree of swelling of the hydrogel fibers, and wherein the hydrogel fibers are configured to change the degree of swelling responsive to changes in an ambient environment of the mesh, wherein the degree of swelling depends on a moisture level of the ambient environment such that when the environment becomes wet, the size of openings decreases, wherein changes in the ambient environment further comprise changes in a salinity level, a temperature level, and a light level of the ambient environment, wherein the degree of swelling depends on the salinity level, temperature level, and light level such that as the salinity level, temperature level, and/or light level increases, the degree of swelling decreases, and as the salinity level, the temperature level, and/or the light level decreases, the degree of swelling increases, and wherein when the moisture level decreases, the degree of swelling decreases, and as the moisture level increases, the degree of swelling increases.

* * * * *